US006119809A

United States Patent [19]

McClendon, Jr.

[11] Patent Number: 6,119,809

[45] Date of Patent: Sep. 19, 2000

[54] COLLAPSIBLE RETRIEVER LADDER

[75] Inventor: Zach McClendon, Jr., Monticello, Ark.

[73] Assignee: SeaArk Boats, Inc., Monticello, Ark.

[21] Appl. No.: 09/385,053

[22] Filed: Aug. 30, 1999

[51] Int. Cl.[7] ..... B63B 17/00

[52] U.S. Cl. ..... 182/84; 182/206; 114/362

[58] Field of Search ..... 182/84, 86, 97, 182/95, 206; 14/79.1; 248/643; 114/362

[56] References Cited

U.S. PATENT DOCUMENTS

| | | | |
|---|---|---|---|
| 2,213,536 | 9/1940 | Solie | 248/643 |
| 2,740,602 | 4/1956 | Kloss | 248/643 |
| 2,964,767 | 12/1960 | Egbert . | |
| 3,134,999 | 6/1964 | Reynolds . | |
| 3,207,566 | 9/1965 | Grieco | 248/205.3 |
| 3,980,157 | 9/1976 | Wrigley . | |
| 4,495,883 | 1/1985 | Hoy | 114/362 |
| 4,823,910 | 4/1989 | Day . | |
| 5,515,806 | 5/1996 | McCabe | 114/362 |
| 5,537,949 | 7/1996 | Blevins et al. . | |

*Primary Examiner*—Alvin Chin-Shue

*Attorney, Agent, or Firm*—Pillsbury Madison & Surto LLP

[57] ABSTRACT

A collapsible retriever ladder generally includes a first platform, a second platform, supporting arms and a clamping mechanism. The first platform is pivotally attached to the supporting arms so that the first platform can be closed. The second platform is pivotally attached to the first platform so that the second platform can fold over the first platform so as to be sandwiched between the first platform and the supporting arms when the first platform is closed. The clamping mechanism secures the ladder to the upper edge of a side of a boat and is pivotally attached to the supporting arms so that the supporting arms having the first and second platforms secured thereto can rotate inwardly of the boat for storage and outwardly of the boat for use.

19 Claims, 4 Drawing Sheets

COLLAPSIBLE RETRIEVER LADDER

FIELD OF THE INVENTION

The present invention relates to a ladder adapted to be attached to a side of a boat. More particularly, the present invention relates to a platform ladder attachable to an upper edge of a side of a boat and rotatable so that the ladder may be positioned inwardly of the boat for storage and outwardly of the boat for use.

BACKGROUND OF THE INVENTION

In the recreational hunting and fishing industry, it is desirable to provide a platform ladder adaptable to be attached to a gunwale (upper edge of a side) of a boat. Such a ladder is typically used in duck hunting to allow a retriever to exit and enter a boat easily. Conventional such ladders are installed on the gunwale of the boat and positioned along an outside of the boat. A problem with the conventional such ladder is that the ladder being disposed on the outside of the boat protrudes beyond the gunwale of the boat to such a great extent that it makes transporting the boat on a trailer difficult. There is also a similar difficulty presented when motoring around trees, brush and other such objects which may be present in a typical duck hunting habitat.

Thus, there exists a need to provide a platform ladder for attachment to a gunwale of a boat which may be conveniently folded into the boat for storage and transport and folded out of the boat for use.

Prior ladders of this general type are found in U.S. Pat. Nos. 5,537,949, 5,515,806, 4,823,910 and 3,980,157.

SUMMARY OF THE INVENTION

To achieve the foregoing objects, the present invention is directed to a collapsible retriever ladder for attachment to an upper edge of a side of a boat.

According to a first embodiment of the invention, the ladder comprises a first platform, a second platform attached to the first platform and configured for movement relative to the first platform, supporting arms having a first end portion and a second end portion, and a clamping mechanism. The first end portion of the supporting arm is latchable to the boat. The first platform is secured to the supporting arm between the first end portion and the second end portion, and is configured for movement relative to the supporting arm. The clamping mechanism is constructed and arranged to firmly grasp the upper edge of the side of the boat, and is pivotally connected to the first end portion of the supporting arm so that the supporting arm having the first and second platform secured thereto can be rotated inwardly of the boat for storage and outwardly of the boat for use.

According to a second embodiment of the invention, the collapsible retriever ladder for attachment to an upper edge of a side of a boat comprises a first platform, a second platform, supporting arms, a clamping mechanism and a leg. The second platform attached to the first platform, and is configured for movement relative to the first platform. The supporting arms have a first end portion and a second end portion. The first end portion of the supporting arms are latchable to the upper edge of the side of the boat. The first platform is secured to the supporting arm between the first end portion and the second end portion. The clamping mechanism is constructed and arranged to firmly grasp the upper edge of the side of the boat, and is pivotally connected to the first end portion of the supporting arms so that the supporting arms can be rotated inwardly of the boat for storage and outwardly for positioning outside of the boat. The leg interconnects the first platform to the supporting arm, and is configured for movement relative to the supporting arm.

Other objects and advantages of the present invention will become apparent from the following claims and detailed description.

DETAILED DESCRIPTION OF THE PREFERRED EMBODIMENT OF THE INVENTION

Figure 1:
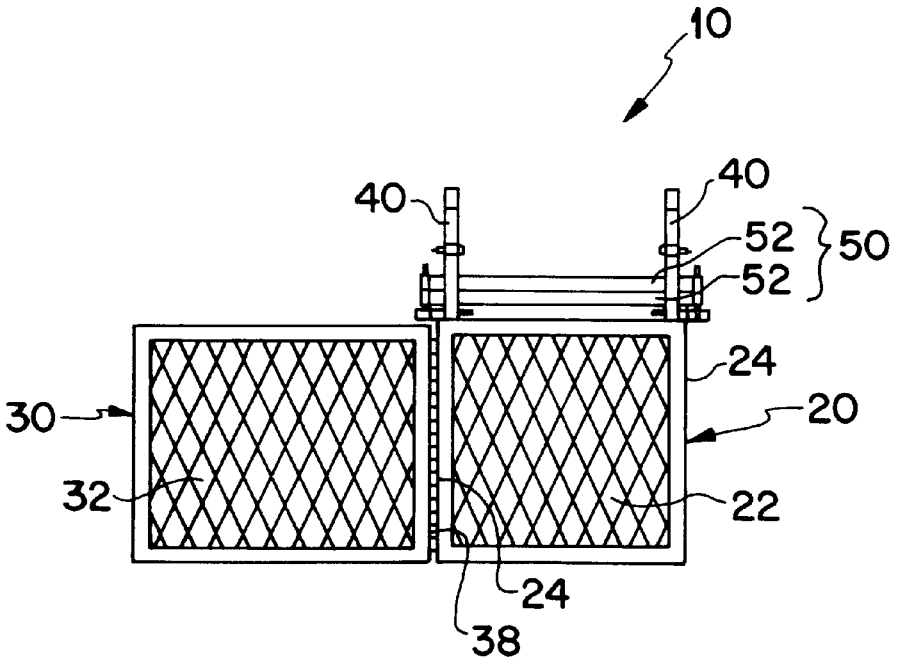
FIG. 1 is a top view of the fold-over ladder in accordance with the present invention in a fully-opened position.

FIG. 1 illustrates an embodiment of a collapsible retriever ladder, generally indicated at 10, in accordance with the present invention for attachment to an upper edge of a side of a boat. The ladder 10 may be formed of metal, plastic or any other material suitable for boat ladders. The ladder 10 generally includes a first platform 20, a second platform 30, supporting arms 40 and a clamping mechanism 50.

Figure 2:
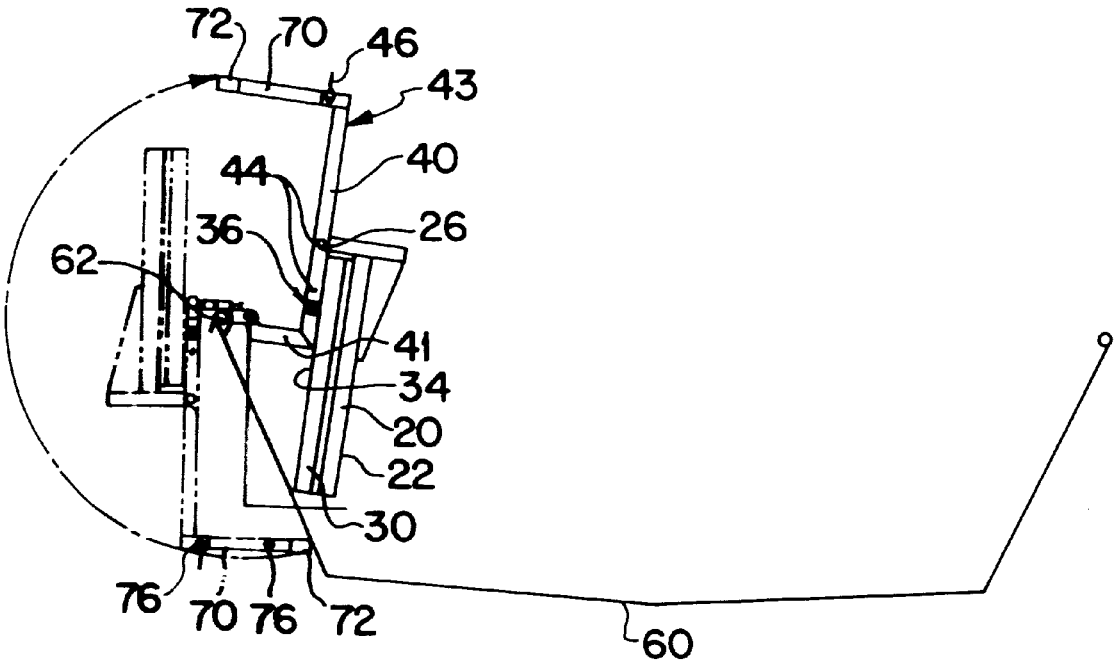
FIG. 2 is an end view of the fold-over ladder in accordance with the present invention attached to the gunwale of the boat and disposed on the inside of the boat in a fully-closed position.

In the illustrated embodiment of FIG. 1, the first platform 20 is essentially square-shaped. It is to be understood that the first platform 20 may also be rectangular in shape. The overall shape of the first platform is immaterial. The first platform may be a solid member or may be formed so as to have a hollow interior. As shown in FIGS. 1 and 2, the first platform defines an upper surface 22, upper edges 24 and sides 26. As shown in the end view of FIG. 2, the upper surface 22 of the first platform is essentially planar. However, the upper surface 22 may also have a raised surface or a depressed surface, and may be patterned or corrugated so as to provide gripping surfaces for the retriever. The first platform 20 is configured for movement relative to the supporting arms 40. In the illustrated embodiment, the first platform 20 is pivotally attached to the supporting arms 40.

Figure 7:
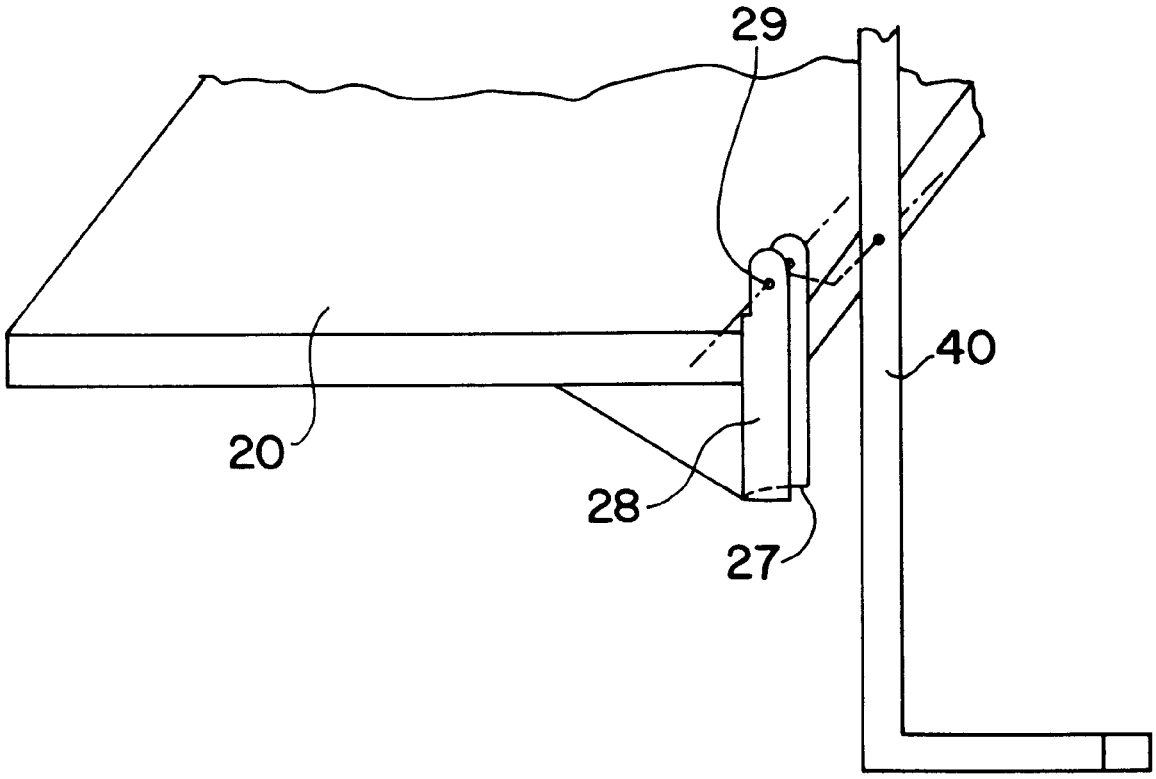
FIG. 7 is a partial perspective view of the fold-over ladder in accordance with a second embodiment of the present invention.

The first platform is provided with an opening 26 which mates with one of the openings 44 of the supporting arms 40 so as to adjust a height of the first platform relative to the supporting arms 40. When a height is selected, opening 26 of the first platform is aligned with one of the openings 44 of the supporting arms 40, and the first platform 20 is fastened to the supporting arms 40. The first platform 20 is fastened to the supporting arms 40 via a fastening element 46. The fastening element 46 may be a safety snap pin or another fastening member which allows for pivotal movement of the first platform 20 relative to the second platform 30. One skilled in the art will readily recognize that other fastening elements may be used. Alternatively, as shown in FIG. 7, the first platform may be pivotally secured to the supporting arms 40 at the selected height via an interconnecting leg 28 which is discussed in more detail below.

A second platform 30, similar in shape and configuration to the first platform 20, is provided. The second platform 30 may be a solid member or may be formed so as to have a hollow interior. The second platform 30 is generally rectangular in shape and has a planar upper surface 32. It is to be understood that the shape of the second platform 30 may also be square or have any other shape suitable for foldable ladders. Although in the illustrated embodiment, the upper surface 32 of the second platform 30 is essentially flat, the upper surface 32 may also have raised portions or depressed portions and be patterned or corrugated. The second platform defines a bottom edge 34, as shown in FIG. 2.

As shown in FIG. 1, the second platform 30 is attached to the first platform 20 so as to be configured for movement relative to the first platform 20. In the illustrated embodiment, the second platform 30 is pivotally attached to the first platform 20 along one of the upper edges 24 of the first platform 20 by way of a hinge 38. However, one skilled in the art will readily recognize that the hinge 38 is not the only possible attaching means. It is also possible that the first and second platforms are freely separable components which snap rotably together.

The second platform 30 is configured for movement relative to the first platform 20 such that the second platform 30 can be folded over the first platform 20, and such that when folded, the upper surface 32 of the second platform 30 overlaps with and opposes the upper surface 22 of the first platform 20.

Figure 5:
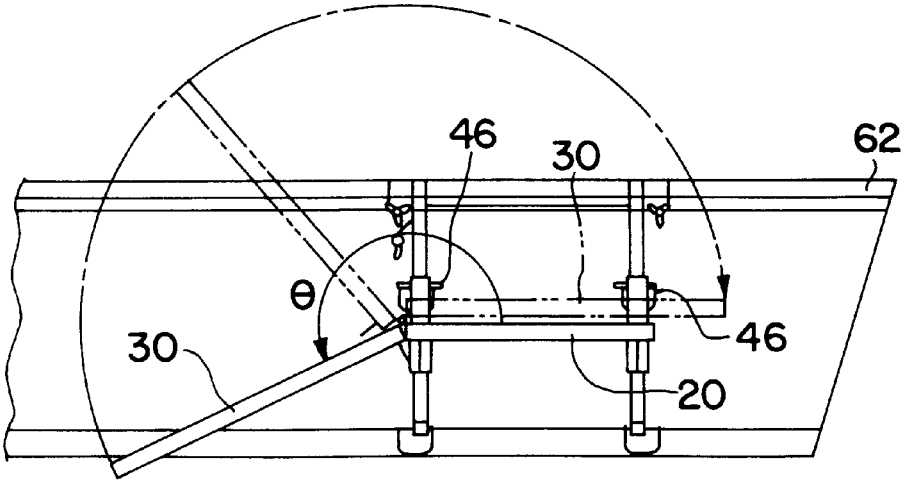
FIG. 5 is a side view of the fold-over ladder in accordance with the present invention in a fully-opened position.

The second platform 30 is also configured for movement relative to the first platform 20 such that the second platform can be unfolded from the first platform 20. As shown in FIG. 5, when unfolded, the second platform 30 is positioned along one of the sides 26 of the first platform 20 so as to form a ramp along the side of the boat 60 when the ladder 10 is disposed on the boat 60. The second platform 30 unfolds to an angle θ, which is greater than 180 degrees from the first platform 20.

Figure 3:
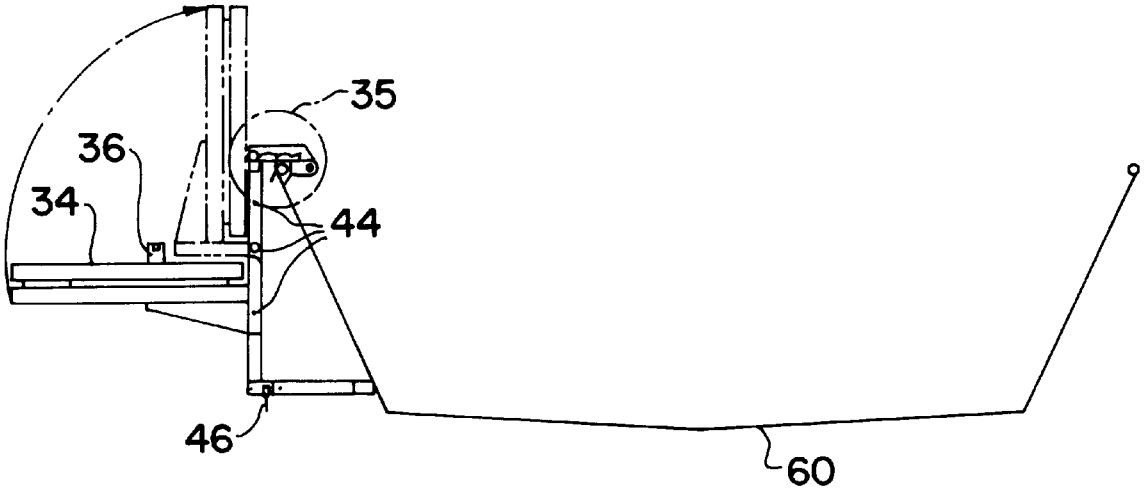
FIG. 3 is an end view of the fold-over ladder in accordance with the present invention attached to the gunwale of the boat and disposed outwardly of the boat in a fully-closed position.
Figure 4:
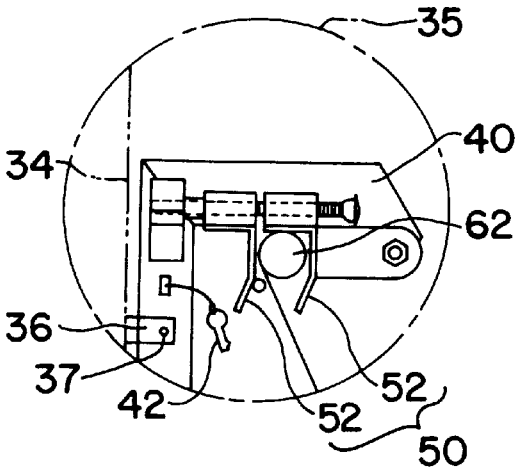
FIG. 4 is an enlargement of a portion 35 shown in FIG. 3, in particular of the clamping mechanism and supporting arm latched to the gunwale of the boat in accordance with the present invention.

As seen in FIGS. 3 and 4, the second platform is provided with a tab 36 along the bottom edge 34. In the illustrated embodiment, the tab 36 is formed with a hole 37 therein. The tab 36 having the hole 37 formed therein is alignable with one of the openings 44 in one of the supporting arms. Once aligned, a fastening element 46 may be used to secure the second platform 30 to the one of the supporting arms 40. In the illustrated embodiment, the fastening element 46 is a safety snap pin. However, it is to be understood that the safety snap pin is not the only means available for securing the tab 36 of the second platform 30 to the one of the supporting arms 40. Other fastening elements such as a nut and bolt assembly may be used.

Figure 6:
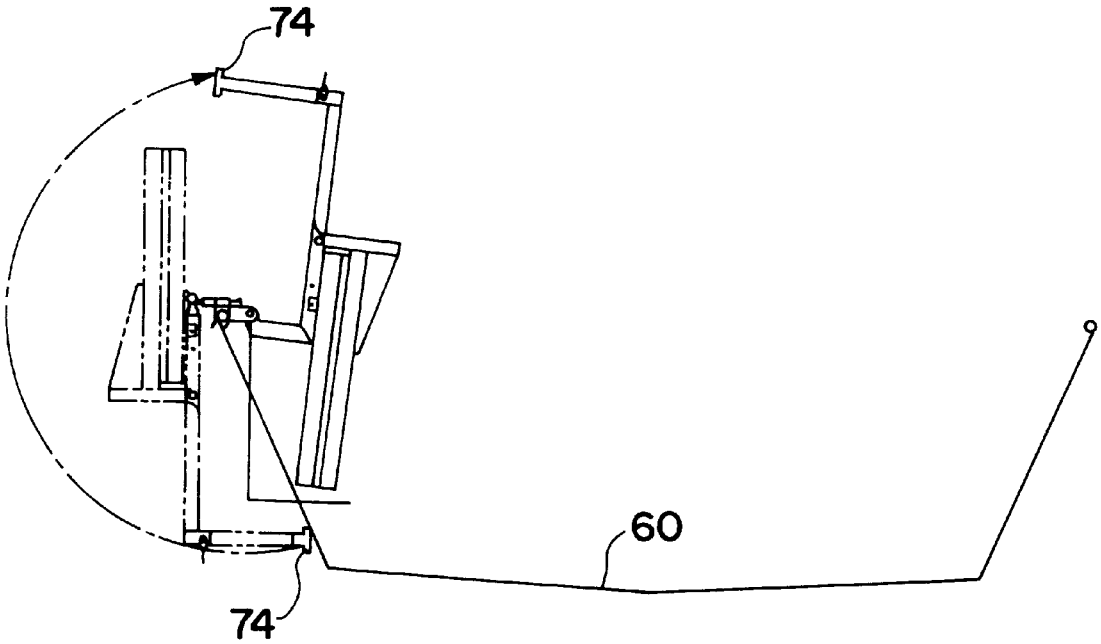
FIG. 6 is an end view of the fold-over ladder showing a stand-off leg in accordance with a second aspect of the present invention.

Located adjacent one of the upper edges 26 of the first platform 20 are the supporting arms 40. The supporting arms are provided with several holes 44 used for adjusting the height of the first platform relative to the supporting arms and for securing the second platform in a folded position to the supporting arms via the tab 36. The supporting arms 40 have a first end portion 41 and a second end portion 43, as shown in FIG. 2. The first end portion 41 is configured to latch to the upper edge side of the boat 60. The first end portion 41, as shown in FIG. 2, may be L-shaped. Alternatively, the first end portion 41 may be J-shaped, having an arched hook portion for latching to the upper edge of the side of the boat 60. The first platform 20 is attached between the first end portion 41 and the second end portion 43 of the supporting arms 40, The second end portion 43 of each of the supporting arms 40 is provided with a stand-off leg 70. The stand-off leg 70 maintains the supporting arms 40 at a distance away from the side of the boat 60 when the ladder 10 is attached to the boat 60. As shown in FIG. 2, an end of the stand-off leg 70 is accommodated with a tip portion 72. The tip portion may be formed of rubber. Alternatively, the tip portion may be an integral part of the stand-off leg 70. As shown in FIG. 6, the tip portion may be a flat disk-shaped portion 74 defined by the stand-off leg 70.

The stand-off leg 70 is provided with openings 76 for adjusting the length of the stand-off leg 70 relative to the supporting arms 40 so as to adjust to the girth of different sized boats.

The stand-off leg 70 may be integrally formed with the supporting arms 40 or may be provided separately. In the case where the stand-off leg 70 is a separate component, the supporting arms 40 define a first opening (not shown) for receiving another end of the stand-off leg 70. The supporting arms 40 further define a second opening (not shown) formed along a center axis which is perpendicular to a center axis of the first opening (not shown). In order to adjust the length of the stand-off leg 70, one of the openings 76 of the stand-off leg 70 is aligned with the second opening (not shown) of the supporting arms 40. In the illustrated embodiment, to secure the stand-off leg 70 in the adjusted position, a safety snap pin 46 is inserted into the aligned openings. It is to be understood that the safety snap pin is not the only fastening means which may be used. Other fastening means such as a nut and bolt combination may be used.

Pivotally connected to the first end portion 41 of the supporting arms 40 is a clamping mechanism 50. The clamping mechanism 50 is constructed and arranged to firmly hold the gunwale 62 of the boat 60. In order to adjust the clamping mechanism 50 so as to accommodate various sized boat gunwales, the clamping mechanism 50 is provided with two clamp brackets 52, as shown in FIG. 4. The clamp brackets 52 are disposed in an opposite relation to each other, and are tightened together in opposing directions so as to provide a firm hold onto the side of the boat 60.

The clamping mechanism 50 is pivotally connected to the first end portion 41 (FIG. 2) of the supporting arms 40, so that the supporting arms 40 can be rotated inwardly of the boat 60 for storage and outwardly of the boat 60 for positioning outside of the boat 60.

When storing the ladder 10, the second platform 30 is folded via hinge 38 over the first platform 20 so that the upper surface 32 of the second platform 30 overlaps with and opposes the upper surface 22 of the first platform 20, and so that an underside (not shown) of the second platform 30 faces the supporting arms 40, i.e., upwardly. When the second platform 30 is in the overlapped position, the first and second platforms 20,30 are pulled upwardly toward the supporting arms 40, as shown in FIG. 3, so that the second platform 30 is sandwiched between the first platform 20 and the supporting arms 40. When the first and second platforms 20,30 in the folded position are pulled near the supporting arms 40, an opening 37 (FIG. 4) formed in tab 36 of the second member 30 aligns with one of the openings 44 (FIG. 3) in one of the supporting arms 40. When the openings 37, 44 are thus-aligned, the second platform 30 having the first platform 20 secured thereto is secured to the one of the supporting arms 40 via a self-locking pin 42. One skilled in the art will readily recognize that other securing means may be used. When the second platform 30 is thus-secured to the one of the supporting arms 40, the ladder 10 is in a fully-closed position.

Once in the fully-closed position, the first and second platforms 20,30 secured to the supporting arms 40 are pulled upwardly toward the inside of the boat 60. As the first and second platforms 20,30 secured to the supporting arms 40 are thus pulled, the supporting arms 40 rotate about the point of pivotal attachment to the clamping mechanism 50, so as to permit the ladder to freely rotate into the boat 60 into the storage position shown in FIG. 2. With such an arrangement, the ladder 10 need not be detached from the boat 60 when transporting or motoring the boat 60. Instead the ladder 10 may be conveniently and easily stored within the boat 60 when not in use.

When positioning the ladder 10 for use, the ladder 10 is unfolded from the fully-closed position. To unfold the ladder 10, the first and second platforms 20,30 secured to the supporting arms 40 are pulled upwardly, and are rotated outwardly of the boat 60. The first and second platforms 20, 30 secured to the supporting arms 40 are rotated outwardly of the boat 60 via the pivotal attachment of the supporting arms 40 to the clamping mechanism 50.

Once the ladder 10 is fully rotated outwardly of the boat 60 so as to be positioned along the side of the boat 60, the second platform 30 is detached from the one of the supporting arms 40. Then, the second platform 30 is unfolded from the first platform 20. In the illustrated embodiment, the second platform 30 is unfolded from the first platform 20 so as to be set at an angle θ greater than 180 degrees. However, it is to be understood that the angle θ is not limited to be being greater than 180 degrees. An angle θ substantially equal to 180 degrees would also be suitable for the practice of the invention. When the second platform 30 is fully unfolded and set to the angle θ, the ladder 10 is in a fully-opened position.

In another aspect of the invention, the first platform 20 is provided with an interconnecting leg 28, as shown in FIG. 7. The leg is configured for movement relative to the first platform 20 and is provided with an opening 29 for adjusting the height of the first platform 30 relative to the supporting arms 40. The opening 29 aligns with the openings 44 of the supporting arm. A fastening element 46 secures the interconnecting leg 28 having the first platform 20 secured thereto to the supporting arms 40 so as to maintain the selected height of the first platform 20 relative to the supporting arms 40.

As shown in FIG. 7, leg 28 defines a U-shaped portion 27 for engaging the supporting arms 40. An inside width of the U-shaped portion is at least equal to an outside width of the supporting arms 40 so that when the first and second platforms 20,30 are rotated to a position outside of the boat 60, the swinging motion of the first and second platforms 20,30 is stopped when the U-shaped portion 27 of the interconnecting leg 28 fully engages the supporting arms 40.

The foregoing detailed description of this invention has been provided for the purposes of illustration and description. It is not intended to be exhaustive or to limit the invention to the precise embodiments disclosed. Other modifications and variations within the spirit and scope of the invention as defined in the appended claims may be evident to practitioners in the art when considered in reference to this disclosure.

What is claimed is:

1. A collapsible retriever ladder for attachment to an upper edge of a side of a boat, comprising:

a first platform;

a second platform attached to the first platform and configured for movement relative to the first platform;

supporting arms having a first end portion and a second end portion, the first end portion of the supporting arms being latchable to the boat, the first platform being secured to the supporting arms between the first end portion and the second end portion, and the first platform being configured for movement relative to the supporting arms, so as to permit the first platform to rotate in a direction toward the supporting arms and so that the first platform can be locked in an upright position adjacent the supporting arms on an external side of the boat; and a clamping mechanism constructed and arranged to firmly grasp the upper edge of the side of the boat, said clamping mechanism being pivotally connected to the first end portion of the supporting arm so that the supporting arm having the first and second platform secured thereto can be rotated inside the boat for storage and outside of the boat for use.

2. The collapsible retriever ladder according to claim 1, wherein the second platform is configured for movement relative to the first platform such that the second platform can be folded-over the first platform and such that an upper surface of the second platform overlaps and opposes an upper surface of the first platform.

3. The collapsible retriever ladder according to claim 1, further including a securing member for securing the second platform to the supporting arm.

4. The collapsible retriever ladder according to claim 3, wherein the securing member is a tab formed along a bottom edge of the second platform.

5. The collapsible retriever ladder according to claim 4, further including a self-locking pin;

wherein the tab having a hole formed therein can align with an opening in one of the supporting arms, the tab being alignable with said opening in said one of the supporting arm when the second platform is folded-over the first platform such that the upper surface of the second platform overlaps with and opposes the upper surface of the first platform and such that an underside of the second platform faces the supporting arms and is sandwiched between the first platform and the supporting arms; and wherein when the hole in the tab and one of the openings of the supporting arm are aligned, the pin can be inserted into the thus-aligned hole and opening so as to secure the first and second platform to the supporting arm, wherein when the second platform is secured to the supporting arm, the ladder is in a fully-closed position, and wherein when the second platform is detached from the supporting arm and unfolded from the first platform, the ladder is in a fully-opened position.

6. The collapsible retriever ladder according to claim 1, further including a fastening element, wherein the supporting arm is provided with openings for adjusting a height of the first platform relative to the supporting arm and the first platform is provided with an opening which mates with any one of the openings formed in the supporting arm, and wherein when the opening in the first platform is aligned with one of the openings in the supporting arm, the fastening element secures the first platform to the supporting arm so as to maintain the height of the first platform relative to the supporting arm.

7. The collapsible retriever ladder according to claim 1, wherein the clamping mechanism comprises two clamp brackets disposed in an opposite relation with each other so that they can be tightened together in opposing directions so as to provide a firm hold onto the upper edge of the side of the boat.

8. The collapsible retriever ladder according to claim 1, wherein the second platform unfolds to an angle θ which is greater than 180 degrees from the first platform.

9. The collapsible retriever ladder according to claim 1, wherein the ladder further comprises a stand-off leg, the stand-off leg being connected to the second end portion of the supporting arm, and maintaining the supporting arm at a distance from the side of the boat when said ladder is attached to the boat.

10. The collapsible retriever ladder according to claim 9, wherein one end of the stand-off leg is accommodated with a tip portion.

11. The collapsible retriever ladder according to claim 9, wherein the tip portion of the stand-off leg is a rubber tip.

12. The collapsible retriever ladder according to claim 9, wherein the tip portion of the stand-off leg is a flat disk-shaped portion.

13. The collapsible retriever ladder according to claim 9, wherein the stand-off leg is formed integrally with each of the supporting arms or formed separately.

14. The collapsible retriever ladder according to claim 9, wherein the second end portion of the supporting arm defines a first opening for receiving another end of the stand-off leg.

15. The collapsible retriever ladder according to claim 14, wherein the second end of the supporting arm defines a second opening for adjusting a length of the stand-off leg, the second opening being formed along a center axis perpendicular to a center axis of the first opening.

16. The collapsible retriever ladder according to claim 15, wherein the stand-off leg defines openings which mate with the second opening of the supporting arm for adjusting the length of the stand-off leg.

17. A collapsible retriever ladder for attachment to an upper edge of a boat, comprising:

a first platform;

a second platform attached to the first platform and configured for movement relative to the first platform;

supporting arms having a first end portion and a second end portion, the first end portion of the supporting arms being latchable to the upper edge of the side of the boat, and the first platform being secured to the supporting arms between the first end portion and the second end portion;

a clamping mechanism constructed and arranged to firmly grasp the upper edge of the side of the boat, said clamping mechanism being pivotally connected to the first end portion of the supporting arms so that the supporting arms can be rotated inside of the boat for storage and outside of the boat for use; and a leg interconnecting the first platform to one of the supporting arms and being configured for movement relative to the one of the supporting arms so as to permit the first platform to rotate inwardly in a direction towards the supporting arms, and so that the first platform can be locked in an upright position adjacent the supporting arms on an external side of the boat.

18. The collapsible retriever ladder according to claim 17, wherein the leg defines a U-shaped portion for engagement with one of the supporting arms, an inside width of the U-shaped portion of the leg being at least equal to an outside width of the one of the supporting arms so that when the first and second platform are rotated to a position outside of the boat, the swinging motion of the first and second platform is stopped when the U-shaped portion of the leg fully engages the one of the supporting arms.

19. The collapsible retriever ladder according to claim 17, further including a fastening element, wherein the supporting arm is provided with openings for adjusting a height of the first platform relative to the supporting arm and the leg is provided with an opening which mates with any one of the openings formed in the supporting arm, and wherein when the opening in the leg is aligned with one of the openings in the supporting arm, the fastening element secures the leg having the first platform secured thereto to the supporting arm so as to maintain the height of the first platform relative to the supporting arm.

* * * * *